US007048846B2

(12) United States Patent
White et al.

(10) Patent No.: US 7,048,846 B2
(45) **Date of Patent: *May 23, 2006**

(54) MEMBRANE SEPARATION FOR SULFUR REDUCTION

(75) Inventors: Lloyd Steven White, Columbia, MD (US); Richard Franklin Wormsbecher, Dayton, MD (US); Markus Lesemann, Baltimore, MD (US)

(73) Assignee: W.R. Grace & Co.-Conn., Columbia, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/382,409

(22) Filed: Mar. 6, 2003

(65) Prior Publication Data

US 2003/0173255 A1 Sep. 18, 2003

Related U.S. Application Data

(63) Continuation of application No. 09/784,898, filed on Feb. 16, 2001, now Pat. No. 6,896,796.

(51) Int. Cl.
*C10G 31/00* (2006.01)
*C10G 67/02* (2006.01)

(52) U.S. Cl. ..... 208/208 R; 208/211; 208/301; 585/818; 210/649

(58) Field of Classification Search ..... 208/211, 208/208 R, 301; 585/818; 210/649
See application file for complete search history.

(56) References Cited

U.S. PATENT DOCUMENTS

| | | | | |
|---|---|---|---|---|
| 2,779,712 | A | 1/1957 | Stine | 196/32 |
| 2,923,749 | A | 2/1960 | Lee et al. | 260/674 |
| 2,958,656 | A | 11/1960 | Stuckey | 210/23 |
| 2,960,462 | A | 11/1960 | Lee et al. | 208/308 |
| 3,179,632 | A | 4/1965 | Hendrix | 260/78 |
| 3,179,633 | A | 4/1965 | Endrey | 260/78 |
| 3,244,763 | A * | 4/1966 | Cahn | 585/818 |
| 3,299,157 | A | 1/1967 | Baddour et al. | 260/674 |
| 3,370,102 | A | 2/1968 | Carpenter et al. | 203/88 |
| 3,546,175 | A | 12/1970 | Angelo | 260/65 |
| 3,556,990 | A | 1/1971 | Gulko | 208/290 |
| 3,708,458 | A | 1/1973 | Alberino et al. | 260/65 |
| 3,789,079 | A | 1/1974 | Perry et al. | 260/681.5 |
| 3,816,303 | A | 6/1974 | Wrasidlo | 210/23 |
| 3,822,202 | A | 7/1974 | Hoehn et al. | 210/23 |
| 3,853,754 | A | 12/1974 | Gosser | 210/23 |
| 3,925,211 | A | 12/1975 | Schumann et al. | 210/500 M |
| 3,956,112 | A | 5/1976 | Lee et al. | 210/22 |
| 4,113,628 | A | 9/1978 | Alegranti | 210/500 M |
| 4,115,465 | A | 9/1978 | Elfert et al. | 260/674 R |
| 4,230,463 | A | 10/1980 | Henis et al. | 55/16 |
| 4,240,914 | A | 12/1980 | Iwama et al. | 210/500 |
| 4,243,701 | A | 1/1981 | Riley et al. | 427/244 |
| 4,307,135 | A | 12/1981 | Fox | 427/244 |
| 4,468,502 | A | 8/1984 | Malon et al. | 525/390 |
| 4,493,714 | A | 1/1985 | Ueda et al. | 55/16 |
| 4,761,229 | A | 8/1988 | Thompson et al. | 210/321.82 |
| 4,781,733 | A | 11/1988 | Babcock et al. | 55/16 |
| 4,879,044 | A | 11/1989 | Feimer et al. | 210/654 |
| 4,929,358 | A | 5/1990 | Koenitzer | 210/640 |
| 4,944,775 | A | 7/1990 | Hayes | 55/16 |
| 4,959,151 | A | 9/1990 | Nakatani et al. | 210/640 |
| 4,962,271 | A | 10/1990 | Black et al. | 585/819 |
| 4,978,439 | A * | 12/1990 | Carnell et al. | 208/91 |
| 4,990,275 | A | 2/1991 | Ho et al. | 252/62.3 |
| 5,005,632 | A | 4/1991 | Henderson et al. | 164/122 |
| 5,019,666 | A | 5/1991 | Sartori et al. | 585/819 |
| 5,045,206 | A | 9/1991 | Chen et al. | 210/640 |
| 5,082,987 | A | 1/1992 | Olbrich et al. | 585/737 |
| 5,104,532 | A | 4/1992 | Thompson et al. | 210/224 |
| 5,159,130 | A | 10/1992 | Satori et al. | 585/819 |
| 5,169,530 | A | 12/1992 | Schucker et al. | 210/321.81 |
| 5,198,002 | A | 3/1993 | Mei et al. | 55/77 |
| 5,238,563 | A | 8/1993 | Smith, Jr. et al. | 210/321.74 |
| 5,241,039 | A | 8/1993 | Ho et al. | 528/322 |
| 5,264,166 | A | 11/1993 | White et al. | |
| 5,265,734 | A | 11/1993 | Linder et al. | 210/654 |
| 5,286,280 | A | 2/1994 | Chiou | 95/45 |
| 5,290,452 | A | 3/1994 | Schucker | 210/640 |
| 5,306,476 | A | 4/1994 | Jalan | 423/220 |
| 5,396,019 | A | 3/1995 | Sartori et al. | 585/819 |

(Continued)

FOREIGN PATENT DOCUMENTS

| | | |
|---|---|---|
| CA | 2111176 | 7/1994 |

(Continued)

OTHER PUBLICATIONS

U.S. Appl. No. 60/258,583.*

*Primary Examiner*—Walter D. Griffin
(74) *Attorney, Agent, or Firm*—Beverly J. Artale; Charles A. Cross

(57) ABSTRACT

A membrane process for the removal of sulfur species from a naphtha feed, in particular, a FCC light cat naphtha, without a substantial loss of olefin yield is disclosed. The process involves contacting a naphtha feed stream with a membrane having sufficient flux and selectivity to separate a sulfur deficient retentate fraction from a sulfur enriched permeate fraction, preferably, under pervaporation conditions. Sulfur deficient retentate fractions are useful directly into the gasoline pool. Sulfur-enriched permeate fractions are rich in sulfur containing aromatic and nonaromatic hydrocarbons and are further treated with conventional sulfur removal technologies, e.g. hydrotreating, to reduce sulfur content. The process of the invention provides high quality naphtha products having a reduced sulfur content and a high content of olefin compounds.

22 Claims, 1 Drawing Sheet

U.S. PATENT DOCUMENTS

| | | | | |
|---|---|---|---|---|
| 5,409,599 | A | 4/1995 | Harandi | 208/210 |
| 5,510,265 | A | 4/1996 | Monticello | 435/282 |
| 5,525,235 | A | 6/1996 | Chen et al. | 210/641 |
| 5,556,449 | A | 9/1996 | Baker et al. | 95/49 |
| 5,635,055 | A | 6/1997 | Sweet et al. | 208/99 |
| 5,643,442 | A * | 7/1997 | Sweet et al. | 208/302 |
| 5,670,052 | A | 9/1997 | Ho et al. | 210/651 |
| 5,733,663 | A | 3/1998 | Scheunemann et al. | 428/447 |
| 5,863,419 | A | 1/1999 | Huff et al. | 208/237 |
| 6,024,880 | A | 2/2000 | Ciora et al. | 210/653 |
| 6,184,176 | B1 | 2/2001 | Khare | 502/407 |
| 6,187,987 | B1 | 2/2001 | Chin et al. | 585/819 |
| 6,274,533 | B1 * | 8/2001 | Khare | 502/343 |
| 6,303,020 | B1 * | 10/2001 | Podrebarac et al. | 208/210 |
| 2002/0111524 | A1 | 8/2002 | Minhas et al. | 585/818 |
| 2002/0130079 | A1 * | 9/2002 | Saxton et al. | 210/650 |
| 2002/0139713 | A1 * | 10/2002 | Plummer et al. | 208/208 R |
| 2002/0139719 | A1 * | 10/2002 | Minhas et al. | 208/250 |

FOREIGN PATENT DOCUMENTS

| | | |
|---|---|---|
| EP | 0 312 376 A2 | 4/1989 |
| GB | 1 434 629 | 5/1976 |
| GB | 2 268 186 A | 1/1994 |
| WO | WO 95/07134 | 3/1995 |
| WO | WO 00/06293 | 2/2000 |
| WO | WO 00/06526 | 2/2000 |
| WO | WO 02/053253 | 7/2002 |
| WO | WO 02/053682 | 7/2002 |
| WO | WO 02/061016 | 8/2002 |
| WO | WO 02/064529 | 8/2002 |

* cited by examiner

FIGURE
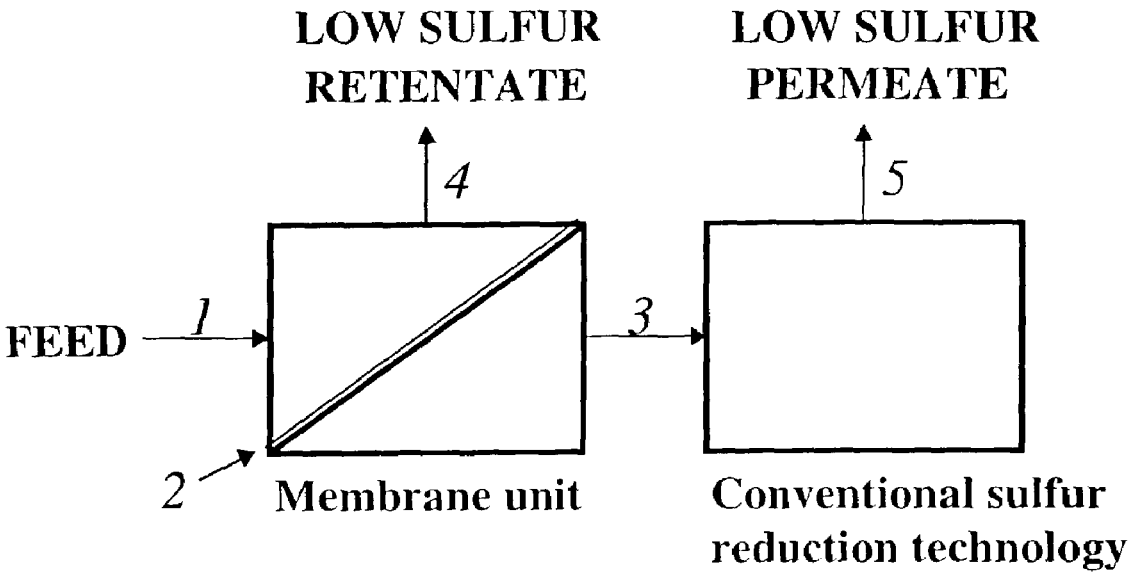

MEMBRANE SEPARATION FOR SULFUR REDUCTION

This application is a continuation of application Ser. No. 09/784,898, filed on Feb. 16, 2001, now U.S. Pat. No. 6,896,796.

FIELD OF THE INVENTION

The present invention relates to a process of reducing sulfur content in a hydrocarbon stream. More specifically, the present invention relates to a membrane separation process for reducing the sulfur content of a naphtha feed stream, in particular, a FCC cat naphtha, while substantially maintaining the initial olefin content of the feed.

BACKGROUND OF THE INVENTION

Environmental concerns have resulted in legislation which places limits on the sulfur content of gasoline. In the European Union, for instance, a maximum sulfur level of 150 ppm by the year 2000 has been stipulated, with a further reduction to a maximum of 50 ppm by the year 2005. Sulfur in the gasoline is a direct contributor of SOx emissions, and it also poisons the low temperature activity of automotive catalytic converters. When considering the effects of changes in fuel composition on emissions, lowering the level of sulfur has the largest potential for combined reduction in hydrocarbon, CO and NOx emissions.

Gasoline comprises a mixture of products from several process units, but the major source of sulfur in the gasoline pool is fluid catalytic cracking (FCC) naphtha which usually contributes between a third and a half of the total amount of the gasoline pool. Thus, effective sulfur reduction is most efficient when focusing attention on FCC naphtha.

A number of solutions have been suggested to reduce sulfur in gasoline, but none of them have proven to be ideal. Since sulfur in the FCC feed is the prime contributor of sulfur level in FCC naphtha, an obvious approach is hydrotreating the feed. While hydrotreating allows the sulfur content in gasoline to be reduced to any desired level, installing or adding the necessary hydrotreating capacity requires a substantial capital expenditure and increased operating costs. Further, olefin and naphthene compounds are susceptible to hydrogenation during hydrotreating. This leads to a significant loss in octane number. Hydrotreating the FCC naphtha is also problematic since the high olefin content is again prone to hydrogenation.

Little has been reported on the selective permeation of sulfur containing compounds using a membrane separation process. For example, U.S. Pat. No. 5,396,019 (Sartori et al.) teaches the use of crosslinked fluorinated polyolefin membranes for aromatics/saturates separation. Example 7 of this patent reports thiophene at a level of 500 ppm.

U.S. Pat. No. 5,643,442 (Sweet et al.) teaches the lowering of sulfur content from a hydrotreated distillate effluent feed using a membrane separation process. The preferred membrane is a polyester-imide membrane operated under pervaporation conditions.

U.S. Pat. No. 4,962,271 (Black et al.) teaches the selective separation of multi-ring aromatic hydrocarbons from lube oil distillates by perstraction using a polyurea/urethane membrane. The Examples discuss benzothiophenes analysis for separated fractions.

U.S. Pat. No. 5,635,055 (Sweet et al.) discloses a method for increasing the yields of gasoline and light olefins from a liquid hydrocarbonaceous feed stream boiling in the ranges of 650° F. to about 1050° F. The method involves thermal or catalytic cracking the feed, passing the cracked feed through an aromatic separation zone containing a polyester-imide membrane to separate aromatic/non-aromatic rich fractions, and thereafter, treating the non-aromatic rich fraction to further cracking processing. A sulfur enrichment factor of less than 1.4 was achieved in the permeate.

U.S. Pat. No. 5,005,632 (Schucker) discloses a method of separating mixtures of aromatics and non-aromatics into aromatic enriched streams and non-aromatics-enriched streams using one side of a poly-urea/urethane membrane.

It would be highly desirable to use a selective membrane separation technique for the reduction of sulfur in hydrocarbon streams, in particular, naphtha streams. Membrane processing offers a number of potential advantages over conventional sulfur removal processes, including greater selectivity, lower operating costs, easily scaled operations, adaptability to changes in process streams and simple control schemes.

SUMMARY OF THE INVENTION

We have now developed a selective membrane separation process which preferentially reduces the sulfur content of a hydrocarbon containing naphtha feed while substantially maintaining the content of olefins presence in the feed. The term "substantially maintaining the content of olefins presence in the feed" is used herein to indicate maintaining at least 50 wt % of olefins initially present in the untreated feed. In accordance with the process of the invention, the naphtha feed stream is contacted with a membrane separation zone containing a membrane having a sufficient flux and selectivity to separate a permeate fraction enriched in aromatic and nonaromatic hydrocarbon containing sulfur species and a sulfur deficient retentate fraction. The retentate fraction produced by the membrane process can be employed directly or blended into a gasoline pool without further processing. The sulfur enriched fraction is treated to reduce sulfur content using conventional sulfur removal technologies, e.g. hydrotreating. The sulfur reduced permeate product may thereafter be blended into a gasoline pool.

In accordance with the process of the invention, the sulfur deficient retentate comprises no less than 50 wt % of the feed and retains greater than 50 wt % of the initial olefin content of the feed. Consequently, the process of the invention offers the advantage of improved economics by minimizing the volume of the feed to be treated by conventional high cost sulfur reduction technologies, e.g. hydrotreating. Additionally, the process of the invention provides for an increase in the olefin content of the overall naphtha product without the need for additional processing to restore octane values.

The membrane process of the invention offers further advantages over conventional sulfur removal processes such as lower capital and operating expenses, greater selectivity, easily scaled operations, and greater adaptability to changes in process streams and simple control schemes.

DETAILED DESCRIPTION OF THE DRAWING

The FIGURE outlines the membrane process of the invention for the reduction of the sulfur content of a naphtha feed stream.

DETAILED DESCRIPTION OF THE INVENTION

The membrane process of the invention is useful to produce high quality naphtha products having a reduced sulfur content and a high olefin content. In accordance with the process of the invention, a naphtha feed containing olefins and sulfur containing-aromatic hydrocarbon compounds and sulfur containing-nonaromatic hydrocarbon compounds, is conveyed over a membrane separation zone to reduce sulfur content. The membrane separation zone comprises a membrane having a sufficient flux and selectivity to separate the feed into a sulfur deficient retentate fraction and a permeate fraction enriched in both aromatic and non-aromatic sulfur containing hydrocarbon compounds as compared to the intial naphtha feed. The naphtha feed is in a liquid or substantially liquid form.

For purposes of this invention, the term "naphtha" is used herein to indicate hydrocarbon streams found in refinery operations that have a boiling range between about 50° C. to about 220° C. Preferably, the naphtha is not hydrotreated prior to use in the invention process. Typically, the hydrocarbon streams will contain greater than 150 ppm, preferably from about 150 ppm to about 3000 ppm, most preferably from about 300 to about 1000 ppm, sulfur.

The term "aromatic hydrocarbon compounds" is used herein to designate a hydrocarbon-based organic compound containing one or more aromatic rings, e.g. fused and/or bridged. An aromatic ring is typified by benzene having a single aromatic nucleus. Aromatic compounds having more than one aromatic ring include, for example, naphthalene, anthracene, etc. Preferred aromatic hydrocarbons useful in the present invention include those having 1 to 2 aromatic rings.

The term "non-aromatic hydrocarbon" is used herein to designate a hydrocarbon-based organic compound having no aromatic nucleus.

For the purposes of this invention, the term "hydrocarbon" is used to mean an organic compound having a predominately hydrocarbon character. It is contemplated within the scope of this definition that a hydrocarbon compound may contain at least one non-hydrocarbon radical (e.g. sulfur or oxygen) provided that said non-hydrocarbon radical does not alter the predominant hydrocarbon nature of the organic compound and/or does not react to alter the chemical nature of the membrane within the context of the present invention.

For purposes of this invention, the term "sulfur enrichment factor" is used herein to indicate the ratio of the sulfur content in the permeate divided by the sulfur content in the feed.

The sulfur deficient retentate fraction obtained using the membrane process of the invention typically contains less than 100 ppm, preferably less than 50 ppm, and most preferably, less than 30 ppm sulfur. In a preferred embodiment, the sulfur content of the recovered retentate stream is from less than 30 wt %, preferably less than 20 wt %, and most preferably less than 10 wt % of the initial sulfur content of the feed.

The FIGURE outlines a preferred membrane process in accordance with the present invention. A naphtha feed stream 1 containing sulfur and olefin compounds is contacted with the membrane 2. The feed stream 1 is split into a permeate stream 3 and a retentate stream 4. The retentate stream 4 is reduced in sulfur content but substantially retains the olefin content of the feed stream 1. The retentate stream 4 may be sent to the gasoline pool without further processing. The permeate stream 3 contains a high sulfur content and is treated with conventional sulfur reduction technology to produce a reduced sulfur permeate stream 5 which is also blended into the gasoline pool.

Advantageously, the total naphtha product resulting from the retentate stream 4 and reduced sulfur permeate stream 5 will have a higher olefin content when compared to the olefin content of a product stream resulting from 100% treatment with conventional sulfur reduction technology, e.g., hydrotreating. Typically, the olefin content of the total naphtha product will be at least 50 wt %, preferably at least 70 wt %, most preferably at least 80 wt %, of the total feed passed over the membrane. For purposes of the invention, the term "total naphtha product" is used herein to indicate the total amount of sulfur deficient retentate product and reduced sulfur permeate product.

The retentate stream 4 and the permeate stream 5 may be used combined into a gasoline pool or in the alternative, may be used for different purposes. For example, retentate stream 4 may be blended into the gasoline pool, while permeate stream 5 is used, for example, as a feed stream to a reformer.

The quantity of retentate 4 produced by the system determines the % recovery, which is the fraction of retentate 4 compared to the initial naphtha feed stream. Preferably, the membrane process is conducted at high % recovery in order to decrease costs. Costs per cubic meter of naphtha treated depends upon such factors as capital equipment, membrane, energy, and operating costs. As the amount of % recovery increases, the required membrane selectivity for a one-stage system increases, while the relative system cost decreases. For a membrane operating at 50% recovery, an overall 1.90 sulfur enrichment factor is typical. At 80% recovery, an overall sulfur enrichment factor of 4.60 is typical. As will be understood by one skilled in the arts, system costs will go down with increased % recovery, since less feed is vaporized through the membrane, requiring lower energy and less membrane area.

Generally, the sulfur deficient retentate fraction contains at least 50 wt %, preferably at least 70 wt %, most preferably at least 80 wt %, of the total feed passed over the membrane. Such a high recovery of sulfur deficient product provides increased economics by minimizing the volume of the feed which is typically treated by high cost sulfur reduction technologies, such as hydrotreating. Typically, the membrane process reduces the amount of naphtha feed sent for further sulfur reduction by 50%, preferably by about 70%, most preferably, by about 80%.

Hydrocarbon feeds useful in the membrane process of the invention comprise naphtha containing feeds that boil in the gasoline boiling range, 50° C. to about 220° C. which fraction contains sulfur and olefin unsaturation. Feeds of this type include light naphthas typically having a boiling range of about 50° C. to about 105° C., intermediate naphtha typically having a boiling range of about 105° C. to about 160° C. and heavy naphthas having a boiling range of about 160° C. to about 220° C. The process can be applied to thermally cracked naphthas such as pyrolysis gasoline and coker naphtha. In a preferred embodiment of the invention, the feed is a catalytically cracked naphtha produced in such processes as Thermofor Catalytic Cracking (TCC) and FCC since both processes typically produce naphthas characterized by the presence of olefin unsaturation and sulfur. In the more preferred embodiment of the invention, the hydrocarbon feed is an FCC naphtha, with the most preferred feed being a FCC light cat naphtha having a boiling range of about 50° C. to about 105° C. It is also contemplated within the scope of the invention that the feed may be a straight run naphtha having a boiling range between about 50° C. to about 220° C.

Membranes useful in the present invention are those membranes having a sufficient flux and selectivity to permeate sulfur containing compounds in the presence of naphtha containing sulfur and olefin unsaturation. The membrane will typically have a sulfur enrichment factor of greater than 1.5, preferably greater than 2, even more preferably from about 2 to about 20, most preferably from about 2.5 to 15. Preferably, the membranes have an asymmetric structure which may be defined as an entity composed of a dense ultra-thin top "skin" layer over a thicker porous substructure of a same or different material. Typically, the asymmetric membrane is supported on a suitable porous backing or support material.

In a preferred embodiment of the invention, the membrane is a polyimide membrane prepared from a Matrimid® 5218 or a Lenzing polyimide polymer as described in U.S. patent application Ser. No. 09/126,261, herein incorporated by reference.

In another embodiment of the invention, the membrane is one having a siloxane based polymer as part of the active separation layer. Typically, this separation layer is coated onto a microporous or ultrafiltration support. Examples of membrane structure incorporating polysiloxane functionality are found in U.S. Pat. No. 4,781,733, U.S. Pat. No. 4,243,701, U.S. Pat. No. 4,230,463, U.S. Pat. No. 4,493,714, U.S. Pat. No. 5,265,734, U.S. Pat. No. 5,286,280 and U.S. Pat. No. 5,733,663, said references being herein incorporated by reference.

In still another embodiment of the invention, the membrane is an aromatic polyurea/urethane membrane as disclosed in U.S. Pat. No. 4,962,271, herein incorporated by reference, which polyurea/urethane membranes are characterized as possessing a urea index of at least 20% but less than 100%, an aromatic carbon content of at least 15 mole %, a functional group density of at least about 10 per 1000 grams of polymer, and a C═O/NH ratio of less than about 8.

The membranes can be used in any convenient form such as sheets, tubes or hollow fibers. Sheets can be used to fabricate spiral wound modules familiar to those skilled in the art. Alternatively, sheets can be used to fabricate a flat stack permeator comprising a multitude of membrane layers alternately separated by feed-retentate spacers and permeate spacers. This device is described in U.S. Pat. No. 5,104,532, herein incorporated by reference.

Tubes can be used in the form of multi-leaf modules wherein each tube is flattened and placed in parallel with other flattened tubes. Internally each tube contains a spacer. Adjacent pairs of flattened tubes are separated by layers of spacer material. The flattened tubes with positioned spacer material is fitted into a pressure resistant housing equipped with fluid entrance and exit means. The ends of the tubes are clamped to create separate interior and exterior zones relative to the tubes in the housing. Apparatus of this type is described and claimed in U.S. Pat. No. 4,761,229, herein incorporated by reference.

Hollow fibers can be employed in bundled arrays potted at either end to form tube sheets and fitted into a pressure vessel thereby isolating the insides of the tubes from the outsides of the tubes. Apparatus of this type are known in the art. A modification of the standard design involves dividing the hollow fiber bundle into separate zones by use of baffles which redirect fluid flow on the tube side of the bundle and prevent fluid channeling and polarization on the tube side. This modification is disclosed and claimed in U.S. Pat. No. 5,169,530, herein incorporated by reference.

Multiple separation elements, be they spirally wound, plate and frame, or hollow fiber elements can be employed either in series or in parallel. U.S. Pat. No. 5,238,563, herein incorporated by reference, discloses a multiple-element housing wherein the elements are grouped in parallel with a feed/retentate zone defined by a space enclosed by two tube sheets arranged at the same end of the element.

The process of the invention employs selective membrane separation conducted under pervaporation or perstraction conditions. Preferably, the process is conducted under pervaporation conditions.

The pervaporation process relies on vacuum or sweep gas on the permeate side to evaporate or otherwise remove the permeate from the surface to the membrane. The feed is in the liquid and/or gas state. When in the gas state the process can be described as vapor permeation. Pervaporation can be performed at a temperature of from about 25° C. to 200° C. and higher, the maximum temperature being that temperature at which the membrane is physically damaged. It is preferred that the pervaporation process be operated as a single stage operation to reduce capital costs.

The pervaporation process also generally relies on vacuum on the permeate side to evaporate the permeate from the surface of the membrane and maintain the concentration gradient driving force which drives the separation process. The maximum temperature employed in pervaporation will be that necessary to vaporize the components in the feed which one desires to selectively permeate through the membrane while still being below the temperature at which the membrane is physically damaged. Alternatively to a vacuum, a sweep gas can be used on the permeate side to remove the product. In this mode the permeate side would be at atmospheric pressure.

In a perstraction process, the permeate molecules in the feed diffuse into the membrane film, migrate through the film and reemerge on the permeate side under the influence of a concentration gradient. A sweep flow of liquid is used on the permeate side of the membrane to maintain the concentration gradient driving force. The perstraction process is described in U.S. Pat. No. 4,962,271, herein incorporated by reference.

In accordance with the process of the invention, the sulfur-enriched permeate is treated to reduce sulfur content using conventional sulfur reduction technologies including, but not limited to, hydrotreating, adsorption and catalytic distillation. Specific sulfur reduction processes which may be used in process of the invention include, but are not limited to, Exxon Scanfining, IFP Prime G, CDTECH and Phillips S-Zorb, which processes are described in Tier 2/Sulfur Regulatory Impact Analysis, Environmental Protection Agency, December 1999, Chapter IV 49–53, herein incorporated by reference.

Very significant reductions in naphtha sulfur content are achievable by the process of the invention, in some cases, sulfur reduction of 90% is readily achievable using the process of the invention, while substantially or significantly maintaining the level of olefins initially present in the feed. Typically, the total amount of olefin compounds present in the total naphtha product will be greater than 50 wt %, preferably from about 60 to about 95 wt %, most preferably, from about 80 to about 95 wt %, of the olefin content of the initial feed.

Sulfur deficient naphthas produced by the process of the invention are useful in a gasoline pool feedstock to provide high quality gasoline and light olefin products. As will be recognized by one skilled in the art, increased economics and higher octane valves are achievable as a whole using the process of the invention since the portion of the total naphtha feed requiring blending and further hydroprocessing is greatly reduced by the process of the invention. Further, since the portion of the feed requiring treatment with conventional olefin-destroying sulfur reduction technologies, such as hydrotreating, is greatly reduced, the overall naphtha product will have a significant increase in olefin content as compared to products treated 100% by conventional sulfur reduction technologies.

To further illustrate the present invention and the advantages thereof, the following specific examples are given. The examples are given as specific illustrations of the claim invention. It should be understood, however, that the invention is not limited to the specific details set forth in the examples.

All parts and percentages in the examples as well as the remainder of the specification are by weight unless otherwise specified.

Further, any range of numbers recited in the specification or claims, such as that representing a particular set of properties, units of measure, conditions, physical states or percentages, is intended to literally incorporate expressly herein by reference or otherwise, any number falling within such range, including any subset of numbers within any range so recited.

EXAMPLES

Membrane coupons are mounted in a sample holder for pervaporation tests. A feed solution of naphtha obtained from a refinery or a model solution mixed in the laboratory is pumped across the membrane surface. The equipment is designed so that the feed solution can be heated and placed under pressure, up to about 5 bar. A vacuum pump is connected to a cold trap, and then to the permeate side of the membrane. The pump generates a vacuum on the permeate side of less than 20 mm Hg. The permeate is condensed in the cold trap and subsequently analyzed by gas chromatography. These experiments were performed at low stage cut so that less than 1% of the feed is collected as permeate. An enrichment factor (EF) is calculated on the basis of sulfur content in the permeate divided by sulfur content in the feed.

Example 1

A commercial pervaporation membrane (PERVAP® 1060) from Sulzer ChemTech, Switzerland, with a polysiloxane separation layer, was tested with a 5 component model feed (Table 1). The membrane shows a substantial permeation rate and an enrichment factor of 2.35 for thiophene. At the higher temperature with naphtha feedstock the mercaptans (alkyl S) had a 2.37 enrichment factor.

The same membrane was also tested with a refinery naphtha stream (Table 2). The compounds at the heavier end of this naphtha sample have higher boiling points than the operating temperature leading to lower permeation rates through the membrane for those components. Increase in temperature gives higher permeation rates.

The comparison of feed solutions between Tables 1 and 2 showed that solutions with both relatively high and low thiophene content can be enriched in the membrane permeate.

TABLE 1

Pervaporation experiments with model feed

| Membrane from Example 1 | Feed | Permeate | Permeate |
|---|---|---|---|
| Feed temperature (° C.) | | 24 | 71 |
| Feed pressure (bar) | | 4.0 | 4.3 |
| Permeate pressure (mm Hg) | | 9.9 | 10.1 |
| 1-Pentene (weight %) | 11.9 | 26.2 | 23.1 |
| 2,2,4-Trimethylpentane (weight %0 | 32.8 | 23.0 | 22.4 |
| Methylcyclohexane (weight %) | 13.1 | 12.1 | 12.1 |
| Toluene (weight %) | 42.2 | 38.6 | 42.5 |
| Thiophene (ppm sulfur) | 248 | 581 | 540 |
| Permeate flux (kg/m$^2$/hr) | | 1.3 | 6.2 |
| Sulfur enrichment factor | | 2.35 | 2.18 |

TABLE 2

Pervaporation experiments with refinery naphtha

| Membrane from Example 1 | Feed | Permeate | Permeate |
|---|---|---|---|
| Feed temperature (° C.) | | 24 | 74 |
| Feed pressure (bar) | | 4.5 | 4.5 |
| Permeate pressure (mm Hg) | | 8.4 | 9.5 |
| Mercaptans (all ppm sulfur) | 39 | 84 | 93 |
| Thiophene | 43 | 124 | 107 |
| Methyl thiophenes | 78 | 122 | 111 |
| Tetrahydro thiophenes | 10 | 13 | 14 |
| C2-Thiophenes | 105 | 68 | 81 |
| Thiophenol | 5 | 1 | 2 |
| C3-Thiophenes | 90 | 24 | 35 |
| Methyl thiophenol | 15 | 0 | 0 |
| C4-Thiophenes | 56 | 0 | 8 |
| Unidentified S in Gasoline Range | 2 | 5 | 5 |
| Benzothiophene | 151 | 16 | 27 |
| Alkyl benzothiophenes | 326 | 28 | 39 |
| Permeate flux (kg/m$^2$/hr) | | 1.1 | 5.0 |
| Sulfur enrichment factor (thiophene) | | 2.91 | 2.51 |

Example 2

A polyimide membrane was fashioned according to the methods of U.S. Pat. No. 5,264,166 and tested for pervaporation. A dope solution containing 26% Matrimid 5218 polyimide, 5% maleic acid, 20% acetone, and 49% N-methyl pyrrolidone was cast at 4 ft/min onto a non-woven polyester fabric with a blade gap set at 7 mil. After about 30 seconds the coated fabric was quenched in water at 22° C. to form the membrane structure. The membrane was washed with water to remove residual solvents, then solvent exchanged by immersion in 2-propanone, followed by immersion in a bath of equal mixtures of lube oil/2-propanone/toluene bath. The membrane was air dried to yield an asymmetric membrane filled with a conditioning agent.

For pervaporation testing, the membrane was rinsed with the feed solution, and then mounted solvent wet in the cell holder. Results for a 5-component model feed are shown in Table 3. Curiously, the pervaporation performance improved at the higher temperature in both flux and selectivity, indicating that process conditions can favorably impact membrane performance. The membrane showed an enrichment factor of 1.68 for thiophene.

TABLE 3

Pervaporation experiments with model feed

| Membrane from Example 2 | Feed | Permeate | Permeate |
|---|---|---|---|
| Feed temperature (° C.) | | 24 | 67 |
| Feed pressure (bar) | | 4.3 | 4.5 |
| Permeate pressure (mm Hg) | | 9.5 | 7.0 |
| 1-Pentene (weight %) | 10.6 | 8.7 | 12.2 |
| 2,2,4-trimethylpentane (weight %) | 34.5 | 32.3 | 31.6 |
| Methylcyclohexane (weight %) | 13.6 | 13.6 | 13.2 |
| Toluene (weight %) | 41.3 | 45.5 | 43.0 |
| Thiophene (ppm sulfur) | 249 | 350 | 423 |
| Permeate flux (kg/m$^2$/hr) | | 1.5 | 5.8 |
| Sulfur enrichment factor | | 1.39 | 1.68 |

Example 3

Another polyimide membrane was fashioned according to the methods of U.S. patent application Ser. No. 09/126,261 and tested for pervaporation. A dope solution containing 20% Lenzing P84, 69% p-dioxane, and 11% dimethylformamide was cast at 4 ft/min onto a non-woven polyester fabric with a blade gap set at 7 ml. After about 3 seconds the coated fabric was quenched in water at 20° C. to form the membrane structure. The membrane was washed with water to remove residual solvents, solvent exchanged by immersion in 2-butanone, followed by immersion in a bath of equal mixtures lube oil/2-butanone/toluene. The membrane was then air dried to yield an asymmetric membrane filled with a conditioning agent.

For pervaporation testing, the membrane was rinsed with the feed solution, and then mounted solvent wet in the cell holder. Results with naphtha are shown in Table 4. The membrane showed an enrichment factor of 4.69 for thiophene. Mercaptans (alkyl S) had a 3.45 enrichment factor. At a rate of 99% recovery of retentate, there is 98.6% recovery of olefins in the retentate.

TABLE 4

Pervaporation Experiments with Refinery Naphtha

| Membrane from Example 3 | Feed | Permeate |
|---|---|---|
| Feed temperature (° C.) | | 77 |
| Feed pressure (bar) | | 4.5 |
| Permeate pressure (mm Hg) | | 5.1 |
| Mercaptans (all ppm sulfur) | 40 | 138 |
| Thiophene | 55 | 257 |
| Methyl thiophenes | 105 | 339 |
| Tetrahydro thiophenes | 11 | 34 |
| C2-Thiophenes | 142 | 220 |
| Thiophenol | 5 | 4 |
| C3-Thiophenes | 77 | 62 |
| Methyl thiophenol | 12 | 8 |
| C4-Thiophenes | 49 | 15 |
| Unidentified S in Gasoline Range | 3 | 15 |
| Benzothiophene | 62 | 26 |
| Alkyl benzothiophenes | 246 | 45 |
| Paraffins (all weight %) | 4.32 | 4.15 |
| Isoparaffins | 30.99 | 18.58 |
| Aromatics | 20.79 | 25.44 |
| Naphthenes | 11.49 | 7.89 |
| Olefins | 32.41 | 43.93 |
| Permeate flux (kg/m$^2$/hr) | | 3.25 |
| Sulfur enrichment factor (thiophene) | | 4.69 |

Since a large fi-action of the olefins are not permeated through the membrane, but retained in the retentate, the octane value of naphtha that can be sent to the gasoline pool is improved.

Example 4

A polyimide composite membrane was formed by spin coating Matrimid 5218 upon a microporous support. A 20% Matrimid solution in dimethylformamide was spin coated at 2000 rpm for 10 sec, then at 4000 rpm for 10 seconds, upon a 0.45 micron pore size nylon membrane disk (Millipore Corporation, Bedford, Mass.; Cat. # HNWP04700). The membrane was then air dried. The membrane was directly tested with naphtha feed (Table 5) and showed an enrichment factor of 2.68 for thiophene. Mercaptans (alkyl S) had a 1.41 enrichment factor. At a rate of 99% recovery of retentate, there was 99.1% recovery of olefins in the retentate.

TABLE 5

Pervaporation Experiments with Refinery Naphtha

| Membrane from Example 4 | Feed | Permeate |
|---|---|---|
| Feed temperature (° C.) | | 78 |
| Feed pressure (bar) | | 4.5 |
| Permeate pressure (mm Hg) | | 4.3 |
| Mercaptans (all ppm sulfur) | 23 | 32 |
| Thiophene | 66 | 176 |
| Methyl thiophenes | 134 | 351 |
| Tetrahydro thiophenes | 16 | 34 |
| C2-Thiophenes | 198 | 356 |
| Thiophenol | 6 | 9 |
| C3-Thiophenes | 110 | 166 |
| Methyl thiophenol | 13 | 14 |
| C4-Thiophenes | 75 | 66 |
| Unidentified S in Gasoline Range | 4 | 8 |
| Benzothiophene | 73 | 95 |
| Alkyl benzothiophenes | 108 | 110 |
| Paraffins (all weight %) | 4.42 | 3.69 |
| Isoparaffins | 28.02 | 21.70 |
| Aromatics | 23.09 | 33.00 |
| Naphthenes | 11.14 | 11.61 |
| Olefins | 33.33 | 30.00 |
| Permeate flux (kg/m$^2$/hr) | | 0.90 |
| Sulfur enrichment factor (thiophene) | | 2.68 |

Example 5

A polyurea/urethane (PUU) composite membrane was formed through coating of a porous substrate following the methods of U.S. Pat. No. 4,921,611. To a solution of 0.7866 g of toluene diisocyanate terminated polyethylene adipate (Aldrich Chemical Company, Milwaukee, Wis.; Cat. # 43,351-9) in 9.09 g of p-dioxane was added 0.1183 g of 4-4'-methylene dianiline (Aldrich; # 13,245-4) dissolved in 3.00 g p-dioxane. When the solution began to gel it was coated with a blade gap set 3.6 mil above a 0.2 micron pore size microporous polytetrafluoroethylene (PTFE) membrane (W. L. Gore, Elkton, Md.). The solvent evaporates to give a continuous film. The composite membrane was then heated in an oven 100° C. for one hour. The final composite membrane structure had a PUU coating 3 microns thick measured by scanning electron microscopy. The membrane was directly tested with naphtha (Table 6). The membrane showed an enrichment factor of 7.53 for thiophene and 3.15 for mercaptans.

TABLE 6

Pervaporation Experiments with Refinery Naphtha

| Membrane from Example 5 | Feed | Permeate |
|---|---|---|
| Feed temperature (° C.) | | 78 |
| Feed pressure (bar) | | 4.5 |
| Permeate pressure (mm Hg) | | 2.6 |
| Mercaptans (all ppm sulfur) | 8 | 25 |
| Thiophene | 49 | 370 |
| Methyl thiophenes | 142 | 857 |
| Tetrahydro thiophenes | 14 | 38 |
| C2-Thiophenes | 186 | 604 |
| Thiophenol | 6 | 12 |
| C3-Thiophenes | 103 | 224 |
| Methyl thiophenol | 20 | 26 |
| C4-Thiophenes | 62 | 99 |
| Unidentified S in Gasoline Range | 1 | 11 |
| Benzothiophene | 101 | 320 |
| Alkyl benzothiophenes | 381 | 490 |
| Permeate flux (kg/m$^2$/hr) | | 0.038 |
| Sulfur enrichment factor (thiophene) | | 7.53 |

Example 6

A polyurea/urethane (PUU) composite membrane was formed as in Example 5, but by replacing p-dioxane with N,N-dimethylformamide (DMF). To 0.4846 g of toluene diisocyanate terminated polyethylene adipate (Aldrich Chemical Company, Milwaukee, Wis.; Cat. # 43,351-9) in 3.29 g of DMF was added 0.0749 g of 4-4'-methylene dianiline (Aldrich; # 13,245-4) dissolved in 0.66 g DMF. When the solution began to gel it was coated with a blade gap set 3.6 mil above a 0.2 micron pore size microporous polytetrafluoroethylene (PTFE) membrane (W. L. Gore, Elkton, Md.). The solvent evaporates to give a continuous film. The composite membrane was then heated in an oven at 94° C. for two hours. The final composite membrane structure had a PUU coating weight of 6.1 g/m$^2$. The membrane was directly tested with naphtha (Table 7). The membrane shows an enrichment factor of 9.58 for thiophene and 4.15 for mercaptans (alkyl S). At a rate of 99% recovery of retentate, there is 99.2% recovery of olefins in the retentate.

TABLE 7

Pervaporation experiments with refinery naphtha

| Membrane from Example 6 | Feed | Permeate |
|---|---|---|
| Feed temperature (° C.) | | 75 |
| Feed pressure (bar) | | 4.5 |
| Permeate pressure (mm Hg) | | 2.8 |
| Mercaptans (all ppm sulfur) | 20 | 84 |
| Thiophene | 33 | 321 |
| Methyl thiophenes | 83 | 588 |
| Tetrahydro thiophenes | 10 | 45 |
| C2-Thiophenes | 105 | 413 |
| Thiophenol | 4 | 8 |
| C3-Thiophenes | 60 | 156 |
| Methyl thiophenol | 12 | 19 |
| C4-Thiophenes | 24 | 116 |
| Unidentified S in Gasoline Range | 0 | 5 |
| Benzothiophene | 44 | 247 |
| Alkyl benzothiophenes | 44 | 245 |
| Paraffins (all weight %) | 4.00 | 1.91 |
| Isoparaffins | 29.48 | 10.33 |
| Aromatics | 26.18 | 57.91 |
| Naphthenes | 10.46 | 4.98 |
| Olefins | 29.88 | 24.87 |
| Permeate flux (kg/m$^2$/hr) | | 0.085 |
| Sulfur enrichment factor (thiophene) | | 9.58 |

Example 7

An FCC light cat naphtha with a boiling range of 50 to 98° C. contains 300 ppm of S compounds. It is pumped at rate of 100 m$^3$/hr into a membrane pervaporation system operated at 98° C.

A sulfur enrichment membrane having a permeation rate of 3 kg/m$^2$/hr is incorporated into a spiral-wound module containing 15 m$^2$ of membrane. The module contains feed spacers, membrane, and permeate spacers wound around a central perforated metal collection tube. Adhesives are used to separate the feed and permeate channels, bind the materials to the collection tube, and seal the outer casing. The modules are 48 inches in length and 8 inches in diameter. 480 of these modules are mounted in pressure housings as a single stage system. Vacuum is maintained on the permeate side. The condensed permeate is collected at a rate of 30 m$^3$/hr and contains greater than 930 ppm S compounds. Overall enrichment factor is 3.1 for S compounds. This permeate is sent to conventional hydrotreating to reduce S content to 30 ppm, and then sent to the gasoline pool.

Retentate generated from the pervaporation system at 70 m$^3$/hr contains less than 30 ppm of sulfur compounds. This naphtha is sent to the gasoline pool. The process reduced the amount of naphtha sent to conventional hydrotreating by 70%.

We claim:

1. A method for lowering the sulfur content of a naphtha hydrocarbon feed stream while substantially maintaining the yield of olefin compounds in the feed stream, said method comprising i) contacting a naphtha feed with a membrane separation zone, said separation zone containing a membrane having a sufficient flux and selectivity to separate a sulfur-enriched permeate fraction and a sulfur deficient retentate fraction, said sulfur deficient retentate fraction having a sulfur content of less than 100 ppm sulfur and comprising at least 50 wt % of olefins present in the naphtha feed under pervaporation conditions, said membrane having a sulfur enrichment factor of greater than 1.5, said naphtha feed being selected from the group consisting of a light naphtha, an intermediate naphtha, a coker naphtha, a straight run naphtha and mixtures thereof, and comprising sulfur containing aromatic hydrocarbons, sulfur containing non-aromatic hydrocarbon and olefin compounds, said sulfur enriched permeate fraction being enriched in sulfur containing aromatic hydrocarbons and sulfur containing non-aromatic hydrocarbons as compared to the naphtha feed;

ii) recovering the sulfur deficient retentate fraction as a product stream;

iii) subjecting the sulfur enriched permeate fraction to a non-membrane process to reduce sulfur content; and iv) recovering a reduced sulfur permeate product stream.

2. The method of claim 1 wherein the membrane is an asymmetric membrane selected from the group consisting of a polyimide membrane, a polyureaurethane membrane and a polysiloxane membrane.

3. The method of claim 1 wherein the membrane is a polyimide membrane.

4. The method of claim 1 wherein the membrane is a polyurea urethane membrane.

5. The method a claim 1 wherein the membrane is a polysiloxane membrane.

6. The method of claim 1 wherein the sulfur content of the sulfur deficient fraction is less than 50 ppm.

7. The method of claim 1 wherein the sulfur content of the sulfur deficient retentate fraction is less than 30 ppm.

8. The method of claim 1 wherein the naphtha feed stream is cracked naphtha.

9. The method of claim 8 wherein the naphtha is a FCC naphtha.

10. The method of claim 9 wherein the naphtha is a FCC light cat naphtha having a boiling range from about 50° C. to about 105° C.

11. The method of claim 1 wherein the naphtha is a coker naphtha.

12. The method of claim 1 wherein the naphtha is a straight run naphtha.

13. The method of claim 1 wherein the sulfur deficient retentate fraction comprises at least 50 wt % of the total feed.

14. The method of claim 13 wherein the sulfur deficient retentate fraction comprises at least 70 wt % of the total feed.

15. The method of claim 1 wherein the non-membrane process is a hydrotreating process to reduce sulfur content.

16. The method of claim 1 wherein the non-membrane process is an adsorption process to reduce sulfur content.

17. The method of claim 1 wherein the non-membrane process is a catalytic distillation process to reduce sulfur content.

18. The method of claim 1 wherein the membrane has a sulfur enrichment factor of greater than 2.

19. The method of claim 1 wherein the membrane has a sulfur enrichment factor ranging from about 2 to about 20.

20. The method of claim 1 wherein the total amount of olefin compounds in the retentate product stream and the reduced sulfur permeate product stream is from about 50 to about 90 wt % of olefin compounds present the feed.

21. The method of claim 1 further comprising combining the sulfur deficient retentate product stream and the reduced sulfur permeate product stream.

22. A method for lowering the sulfur content of a naphtha hydrocarbon feed stream while substantially maintaining the yield of olefin compounds in the feed stream, said method comprising i) contacting a naphtha feed with a membrane separation zone, said separation zone containing a membrane having a sufficient flux and selectivity to separate a sulfur-enriched permeate fraction and a sulfur deficient retentate fraction having a sulfur content of less than 100 ppm sulfur, said sulfur deficient retentate fraction comprising at least 50 wt % of the naphtha feed and at least 50 wt % of olefins present in the naphtha feed under pervaporation conditions, said membrane having a sulfur enrichment factor of greater than 1.5, said naphtha feed being selected from the group consisting of a light naphtha, an intermediate naphtha, a coker naphtha, a straight run naphtha and mixtures thereof, and comprising sulfur containing aromatic hydrocarbons, sulfur containing non-aromatic hydrocarbons and olefin compounds, said sulfur enriched permeate fraction being enriched in sulfur containing aromatic hydrocarbons and sulfur containing non-aromatic hydrocarbons as compared to the naphtha feed;

ii) recovering the sulfur deficient retentate fraction as a product stream;

iii) subjecting the sulfur enriched permeate fraction to a non-membrane process to reduce sulfur content; and iv) recovering a reduced sulfur permeate product stream.

* * * * *